US009244397B2

(12) United States Patent
Takami

(10) Patent No.: US 9,244,397 B2
(45) Date of Patent: Jan. 26, 2016

(54) IMAGE HEATING APPARATUS HAVING FIXING MEMBER AND SUPPLYING COOLING AIR TO A NON-SHEET-PASSING AREA FOR COOLING THE FIXING MEMBER

(71) Applicant: CANON KABUSHIKI KAISHA, Tokyo (JP)

(72) Inventor: Hiroshi Takami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 13/684,905

(22) Filed: Nov. 26, 2012

(65) Prior Publication Data

US 2013/0142536 A1 Jun. 6, 2013

(30) Foreign Application Priority Data

Dec. 1, 2011 (JP) ..... 2011-263566

(51) Int. Cl.
*G03G 15/20* (2006.01)
*G03G 21/20* (2006.01)

(52) U.S. Cl.
CPC ..... *G03G 15/2039* (2013.01); *G03G 15/2042* (2013.01); *G03G 15/2017* (2013.01)

(58) Field of Classification Search
CPC ..... G03G 15/2017; G03G 15/2021; G03G 15/2039
See application file for complete search history.

(56) References Cited

U.S. PATENT DOCUMENTS 7,193,181 B2 3/2007 Makihira et al.
7,199,335 B2 4/2007 Takami et al.
7,266,314 B2 9/2007 Takami
7,283,145 B2 10/2007 Kato et al.
7,561,818 B2 * 7/2009 Arimoto ..... G03G 21/206 399/33
2006/0127119 A1 * 6/2006 Sato ..... G03G 15/2017 399/69

FOREIGN PATENT DOCUMENTS

| | | | | |
|---|---|---|---|---|
| EP | 188972 | A | * | 7/1986 |
| JP | 4-51179 | A | | 2/1992 |
| JP | 5-119669 | A | | 5/1993 |
| JP | 2001-331058 | A | | 11/2001 |
| JP | 2003-76209 | A | | 3/2003 |
| JP | 2009180909 | | * | 8/2009 |
| JP | 2009180909 | A | * | 8/2009 |
| JP | 2009-251030 | A | | 10/2009 |
| JP | 2010-72399 | A | | 4/2010 |
| JP | 2011-133691 | A | | 7/2011 |
| KR | 720363 | | * | 5/2007 |
| KR | 720363 | B1 | * | 5/2007 |

* cited by examiner

*Primary Examiner* — Clayton E LaBalle
*Assistant Examiner* — Victor Verbitsky
(74) *Attorney, Agent, or Firm* — Fitzpatrick, Cella, Harper & Scinto

(57) ABSTRACT

The image heating apparatus heats a toner image beard on a recording material while conveying the recording material at a nip portion, and includes: a heater; a fixing member; a pressure member; a first temperature detecting member; a second temperature detecting member configured to detect a temperature on non-sheet-passing area; a control device; and an air supplying member supplying an air to the non-sheet-passing area. The air supplying member is started to be drive when a temperature detected by the second temperature detecting member reaches a predetermined temperature which is higher than the target temperature. The control device controls the quantity of the air in response to information related to the power supplied to the heater when a temperature detected by the second temperature detecting member reaches the predetermined temperature.

5 Claims, 11 Drawing Sheets

SHUTTER POSITION SETTING TABLE

| | SHEET SIZE | | |
|---|---|---|---|
| | GROUP A | GROUP B | GROUP C |
| | A3 VERTICAL<br>A4 HORIZONTAL | LTR HORIZONTAL<br>B5 HORIZONTAL | LTR VERTICAL<br>ENVELOPE VERTICAL<br>A4 VERTICAL |
| SHUTTER POSITION | CLOSE | A | B |

FAN DRIVING VOLTAGE SETTING TABLE

| HEATER CURRENT VALUE | SHEET SIZE | | | |
|---|---|---|---|---|
| | I GROUP | II GROUP | III GROUP | IV GROUP |
| | A3 VERTICAL A4 HORIZONTAL | LTR HORIZONTAL B5 HORIZONTAL | LTR VERTICAL A4 VERTICAL | ENVELOPE VERTICAL |
| Ifd<5A | STOP | 10V | 10V | 10V |
| 5A≦Ifd<7A | STOP | 10V | 10V | 15V |
| 7A≦Ifd<9A | STOP | 10V | 15V | 15V |
| 9A≦Ifd<11A | STOP | 15V | 15V | 22V |
| 11A≦Ifd | STOP | 15V | 22V | 22V |

IMAGE HEATING APPARATUS HAVING FIXING MEMBER AND SUPPLYING COOLING AIR TO A NON-SHEET-PASSING AREA FOR COOLING THE FIXING MEMBER

BACKGROUND OF THE INVENTION

1. Field of the Invention

The present invention relates to an image heating apparatus which is used for heating an image on a recording material in an electrophotographic or electrostatic recording image forming apparatus such as a printer, a copier, a facsimile, or a multifunction machine having a plurality of functions thereof.

An image heating apparatus includes, for example, a fixing device that fixes an unfixed image on a recording material, and a gloss increasing device configured to heat an image fixed on a recording material to increase the gloss of the image.

2. Description of the Related Art

An electrophotographic image forming apparatus often uses a heat-roller-type or film-fixing-type fixing device configured to fix an unfixed toner image on a recording material. The heat-roller-type fixing device generally includes a fixing roller as a fixing member and a pressure roller as a pressure member that are pressed against each other and rotated. The fixing roller includes a desired functional layer such as a release layer, or an elastic layer and a release layer on an outer periphery of a metal hollow roller base member.

The hollow roller base member is heated from inside by a heater such as a halogen lamp provided in the body, and power supplied to the heater is controlled so that an outer surface of the fixing roller is maintained at a predetermined fixable temperature. The pressure roller has a rubber layer on a circumstance surface of a bar core, and is elastically pressed against the fixing roller to form a nip portion having a predetermined width between the pressure roller and the fixing roller. Generally, a recording material bearing an unfixed toner image is introduced into the nip portion and held and conveyed, and the unfixed toner image is fixed as a fixed image on a recording material surface by the heat of the fixing roller and the nip pressure.

The film-fixing-type fixing device includes a heater such as a ceramic heater fixedly supported, and a tubular film as a fixing member configured to come into contact with the heater. The fixing device also includes a pressure roller configured to be pressed against the heater via the film to form a nip portion between the pressure roller and the film. Generally, a recording material bearing an unfixed toner image is conveyed in the nip portion, and the unfixed toner image is fixed on the recording material by the heat of the film heated by the heater and the pressure of the nip portion.

In the film-fixing-type fixing device, the film is directly heated by the heater. After the power is turned on, the nip portion reaches a predetermined temperature in a short time, thereby significantly reducing the waiting time after the power is turned on. Heating only a necessary section of the film advantageously reduces power consumption. An on-demand device can be configured using a heater and film material having a low heat capacity.

Consequently, the ceramic heater as a heat source may be electrified and heated to a predetermined fixing temperature only when image forming is performed, thereby providing an advantage of a short waiting time from powering on of the apparatus to a state where image forming can be performed, that is, a quick start property, and a significantly low power consumption during standby.

In the heat-roller-type or the film-fixing-type fixing device as described above, when small-size recording materials having a smaller width than a maximum-size recording material having a maximum width that can be passed in the device are continuously passed and subjected to fixing, an excessive increase in surface temperature on a non-sheet-passing area of the fixing member, that is, a temperature at the non-sheet-passing area increase may occur.

This is because if the small-size recording materials are continuously passed, heat is not removed by the recording materials but is stored in the non-sheet-passing area of the nip portion through which the recording material is not passed. This phenomenon is referred to as a non-sheet-passing-area temperature increase of the fixing device, and an excessive temperature increase at the non-sheet-passing area may cause hot offset, or thermal degradation of components that constitutes the device. More specifically, in order to fix an entire area of a maximum-size recording material, for example, an A4 horizontal sheet (297 mm), the temperature of the fixing member in a width direction needs to be uniform over a width or more of the maximum-size recording material.

However, if small-size recording materials having a smaller width than the maximum-size recording material, for example, A4 vertical sheets (210 mm size) are continuously passed, the temperature of the fixing member excessively increases at the non-sheet-passing area, and there is a difference in temperature of the fixing member between a sheet-passing area and the non-sheet-passing area. Thus, if the maximum-size recording material, or a middle-size recording material (for example, B4 vertical sheet) having a larger width than the small-size recording materials continuously passed is passed, hot offset may occur in a section corresponding to a non-sheet-passing area of the small-size recording material to produce a poor image.

The excessive temperature increase on the non-sheet-passing area of the fixing member that occurs in the continuous passage of the small-size recording materials described above is particularly remarkable in a film-fixing-type fixing device including a fixing member having a reduced heat capacity for energy saving. In order to prevent hot offset caused by the temperature increase at non-sheet-passing area, a conventional fixing device provides a period for cooling the non-sheet-passing area after continuous passage of the small-size recording materials.

Specifically, after continuous passage of the small-size recording materials, a period is provided in which a next print job is not accepted for a predetermined time or until a signal value of a detecting unit, configured to detect the temperature of the fixing member or the pressure member on the non-sheet-passing area, reaches a predetermined value. After substantially uniform temperature distribution is obtained over the entire area in the width direction of the fixing member or the pressure member, the maximum-size recording material or the like is passed. However, it takes several ten seconds to several minutes to obtain substantially uniform temperature distribution over the entire area in the width direction of the fixing member or the pressure member, thereby reducing productivity.

A configuration is also known in which an air supplying fan is provided in a fixing device, and a cooling system is provided, which is configured to supply air to non sheet-passing areas on opposite end portions of a fixing roller and a pressure roller and to cool the non-sheet-passing areas, thereby suppressing temperature increase at a non-sheet-passing area. In Japanese Patent Application Laid-Open No. H04-051179, an air supplying fan placed in a fixing device selectively supplies cooling air to non-sheet-passing areas on opposite end portions. Japanese Patent Application Laid-Open No. 2003-076209 discloses a configuration in which when an air supplying fan supplies cooling air to a non-sheet-passing area, an air supplying area of the air supplying fan can be adjusted according to a width of a recording material to be passed to accommodate recording materials of different sizes.

Japanese Patent Application Laid-Open No. 2010-072399 discloses a configuration in which a temperature detecting member, configured to detect the temperature on a non-sheet-passing area of a fixing member, is provided to adjust the quantity of air of an air supplying fan according to a detection temperature.

However, the conventional fixing devices described above, including the cooling system in which the air supplying fan is provided to supply air to a heating roller and a pressure roller in a non-sheet-passing area, have the problems described below. The cooling capacity of the air supplying fan sometimes does not reach a proper level, depending on the types of recording materials that are passed, which may cause poor fixing or hot offset. FIG. 1A illustrates a schematic configuration of a fixing device including an air supplying fan, and its relationship to the temperature distribution in a ceramic heater section. A recording material 401, a ceramic heater heat generating section 404, and air supplying fans 402 and 403 are provided. The recording material 401 is conveyed around a broken line B passing through a central portion of the ceramic heater 404.

The amount of heat generation of the ceramic heater heat generating section 404 is adjusted based on a result of a temperature detecting unit provided at a point Q on the central portion of the ceramic heater heat generating section 404, and the central portion of the ceramic heater heat generating section 404 is controlled to a desired temperature. A line K and a broken line J each show the temperature distribution of the ceramic heater heat generating section 404 when recording materials having different heat capacities are passed. The broken line J shows the temperature distribution when a recording material having a high heat capacity is passed, and the line K shows the temperature distribution when a recording material having a lower heat capacity, as compared to the broken line J, is passed. As shown, the temperature at non-sheet-passing areas G and H is higher for a recording material having a higher heat capacity.

Heat generated by the ceramic heater heat generating section 404 is transferred to a recording material to be passed. At this time, the amount of heat transferred to a recording material increases with an increase in the heat capacity of the recording material. Specifically, the temperature difference between the recording material sheet-passing area and the non-sheet-passing areas G and H of the ceramic heater heat generating section 404 increases with an increase in the heat capacity of the recording material. The temperature increase at the non-sheet-passing areas G and H increases temperatures on recording material end portions L and M to cause hot offset. In order to prevent hot offset, a method is conceivable for cooling the non-sheet-passing areas G and H by uniformly increasing the quantity of air of the air supplying fan.

However, in this case, passage of a recording material having a low heat capacity reduces the temperature at the recording material end portions L and M to cause poor fixing. A method is conceivable of solving the above problem by providing a member configured to detect the heat capacity of a recording material or a member configured to detect an environmental temperature in the device, and adjusting the quantity of air of an air supplying fan according to a detection result, which increases cost of the device.

A method is conceivable of providing a thermistor configured to detect the temperature on a non-sheet-passing area of a fixing member through which a recording material is not passed, and adjusting the quantity of air of an air supplying fan according to the detection temperature. However, if the quantity of air is determined based on the temperature at the non-sheet-passing area, the temperature may overshoot to cause poor fixing or hot offset when the temperature increasing speed is high.

If the quantity of air is uniformly set in response to the case of a high temperature increasing speed on the end portion of the fixing member, overcooling may cause poor fixing. If the quantity of air is set in response to the case of a low temperature increasing speed on the end portion, an insufficient cooling capacity may damage the fixing member (film).

SUMMARY OF THE INVENTION

In one or more embodiments of the present invention, an object is to provide an image heating apparatus that can quickly ensure a stable image heating property,irrespective of the type (heat capacity) of a recording material or the environmental temperature outside the apparatus.

As a first aspect of the present invention, an image heating apparatus for heating a toner image borne on a recording material while conveying the recording material at a nip portion includes a heater, a fixing member heated by the heater, a pressure member configured to form the nip portion with the fixing member, a first temperature detecting member configured to detect the temperature on a sheet-passing area of the fixing member or the heater, a second temperature detecting member configured to detect the temperature on a non-sheet-passing area, which is situated on an end portion of the fixing member or the heater, a control device configured to control the power supplied to the heater such that the temperature detected by the first temperature detecting member becomes a target temperature, and an air supplying member supplying air to the non-sheet-passing area, wherein the air supplying member is started to be driven when the temperature detected by the second temperature detecting member reaches a predetermined temperature, which is higher than the target temperature. The control device controls the quantity of the air in response to information related to the power supplied to the heater when the temperature detected by the second temperature detecting member reaches the predetermined temperature.

As a second aspect of the present invention, an image heating apparatus for heating a toner image borne on a recording material while conveying the recording material at a nip portion includes a heater, a fixing member heated by the heater, a pressure member configured to form the nip portion with the fixing member, a first temperature detecting member configured to detect the temperature at a sheet-passing area of the fixing member or the heater, a second temperature detecting member configured to detect the temperature at a non-sheet-passing area, which is situated on an end portion of the fixing member or the heater, a control device configured to control the power supplied to the heater such that the temperature detected by the first temperature detecting member becomes a target temperature, and an air supplying member supplying an air to the non-sheet-passing area, the air supplying member being started to be driven when the temperature detected by the second temperature detecting member reaches a predetermined temperature, which is higher than the target temperature. The control device controls the quantity of the air in response to an electric current flowing in the heater or a voltage applied to the heater when the temperature detected by the second temperature detecting member reaches the predetermined temperature.

As a third aspect of the present invention, an image heating apparatus for heating a toner image borne on a recording material while conveying the recording material at a nip portion includes a heater, a fixing member heated by the heater, a pressure member configured to form the nip portion with the fixing member, a temperature detecting member configured to detect the temperature on a sheet-passing area of the fixing member or the heater, a control device configured to control the power supplied to the heater such that the temperature detected by the temperature detecting member becomes a target temperature, and an air supplying member supplying air to a non-sheet-passing area of the fixing member or the heater.

The control device controls the quantity of the air in response to information related to the power supplied to the heater.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

(Image Forming Apparatus)

Figure 2:
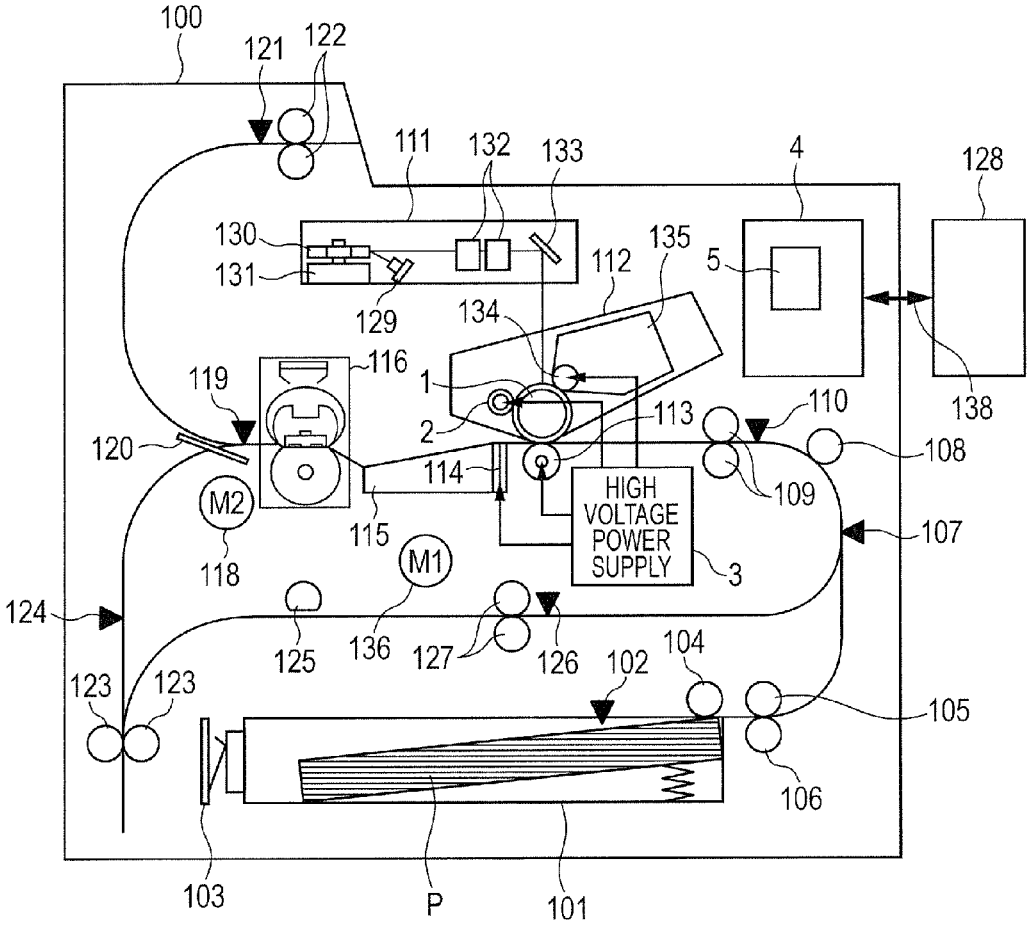
FIG. 2 is a configuration view of the entire configuration of an image forming apparatus including the image heating apparatus according to this embodiment.

FIG. 2 shows a configuration view of a laser beam printer 100 including a fixing device as an image heating apparatus of this embodiment. The laser printer 100 includes a deck 101 housing a recording material P, and a sheet presence/absence sensor configured to detect the presence or absence of the recording material P in the deck 101, and a recording material size detecting sensor 103 configured to detect the size of the recording material P in the deck 101. Further, a pickup roller 104 configured to discharge the recording material P from the deck 101, a deck sheet feeding roller 105 configured to convey the discharged recording material P, and a retarding roller 106 paired with the deck sheet feeding roller 105 and configured to prevent double feeding of the recording material P.

The deck 101, and a sheet feeding sensor 107 configured to detect a sheet feeding and conveying state from an inverting section for a sheet both sides described later are provided downstream of the deck sheet feeding roller 105. Further, a sheet feeding and conveying roller 108 configured to convey the recording material P downstream, a pair of registration rollers 109 configured to convey the recording material P in synchronization with printing timing, and a pre-registration sensor 110 configured to detect a conveying state of the recording material P to the pair of registration rollers 109 are provided. A process cartridge 112 configured to emit a laser light from a laser scanner section 111 to form a toner image on a photosensitive drum 1 based on an image information from a video controller 128 is provided downstream of the pair of registration rollers.

A roller member 113 (hereinafter referred to as a transfer roller) for transferring the toner image formed on the photosensitive drum 1 onto the recording material P, and a needle 114 for a removal of electricity for removing charges on the recording material P and facilitating separation from the photosensitive drum 1 are provided. Further, a conveying guide 115, a fixing device 116 configured to thermally fix the toner image transferred onto the recording material P, and a fixing sheet discharge sensor 119 configured to detect a conveying state from the fixing device 116 are provided downstream of the needle 114 for a removal of electricity. A both-sides flapper 120 is provided for switching a destination of the recording material P conveyed from the fixing device 116 between a sheet discharging section and an inverting section for printing on both sides of a sheet.

A sheet discharge sensor 121 configured to detect a sheet conveying state of the sheet discharging section, and a pair of sheet discharging rollers 122 configured to discharge the recording material are provided downstream of the sheet discharging section. The inverting section for permitting printing on both sides of a sheet is provided for inverting the recording material P after one-side printing and again feeding the recording material P to an image forming section for both-sides printing of the recording material P. A pair of inversion rollers 123 configured to switch back the recording material P by forward and reverse rotation, and an inversion sensor 124 configured to detect a sheet conveying state to the inversion roller 123 are provided in the inverting section for printing on a sheet on both sides.

A sheet feeding roller 125 for conveying the recording material P from a registration section (not shown) for alignment of a horizontal position of the recording material P, and a both-sides sensor 126 configured to detect a conveying state of the recording material P by the inverting section for printing on a sheet on both sides are provided. Further, a pair of both-sides conveying rollers 127 is provided for conveying the recording material P from the inverting section for printing on a sheet on both sides to the sheet feeding section. A series of control operations of the image forming apparatus is performed by a central processing unit (CPU) 5 provided in an engine controller 4.

(Image Heating Apparatus)

An exemplified image heating apparatus according to the present invention is connected to a control device provided in the image forming apparatus, but the control device may be provided in the image heating apparatus.

Figure 1A:
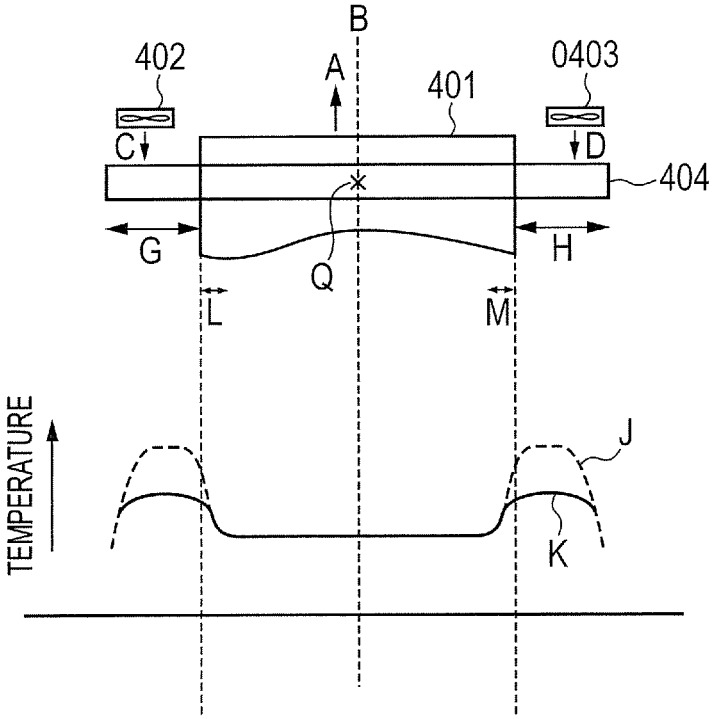
FIG. 1A illustrates the problems with a conventional fixing device.
Figure 1B:
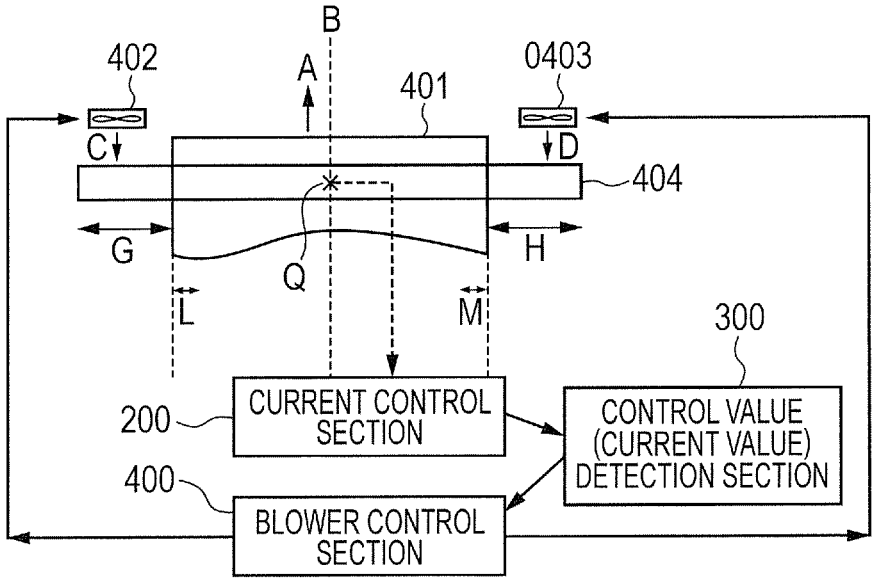
FIG. 1B illustrates an outline of an image heating apparatus according to a first embodiment.

FIG. 1B is a top view of the image heating apparatus according to this embodiment. The recording material 401 is passed in a direction A, and the amount of electric current supplied to the ceramic heater heat generating section 404 is controlled by an electric current control unit 200 so that the detection temperature of a thermistor (temperature detecting unit) located on a central portion Q in a longitudinal direction of the ceramic heater heat generating section 404 becomes a predetermined temperature.

As described later, a control value (electric current value) that controls the quantity of air is detected by a control value (electric current value) detecting unit 300 as a power supply amount detecting unit, and the air supplying control unit 400 supplies air for cooling a non-sheet-passing area by a quantity of air according to the control value (electric current value). The sheet-passing area is an area through which recording materials having various widths are passed, while the non-sheet-passing area is an area through which a recording material is not passed when a recording material having a smaller width than a maximum-size recording material that can be passed is passed. The CPU 5 (in the image forming apparatus) has both functions of the electric current control unit 200 and the air supplying control unit 400 as described later.

Figure 3:
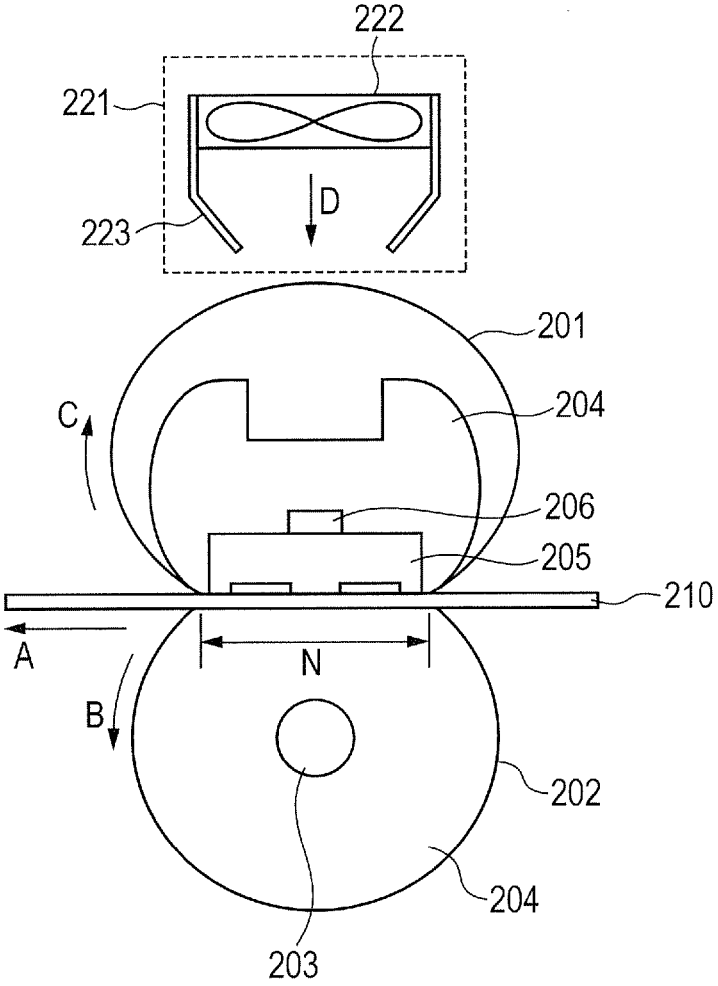
FIG. 3 is a configuration view of a fixing device as an image heating apparatus of a first embodiment.

FIG. 3 is a schematic configuration view of a film-heating-type fixing device according to this embodiment. A heat-resistant/heat-insulating rigid stay 204 for securing a ceramic heater and guiding a film inner surface is a long member in a direction crossing a conveying path of a recording material 210 (perpendicular to the drawing). A ceramic heater 205, described later, is a long member in a direction crossing a transfer material conveying path, which is fitted in a groove formed in the longitudinal direction in a lower surface of the stay 204 and fixedly supported by a heat-resistant adhesive.

A tubular film 201 as a fixing member is loosely externally fitted to the stay 204 to which the heater 205 is mounted. A thickness of the film 201 heated by the heater 205 is 40 to 100 μm.

The material of the film 201 is a cylindrical single layer film such as PTFE (polytetrafluoroethylene) or PFA (tetrafluoroethylene-perfluoro alkyl vinyl ether copolymer) having heat resistance, a releasing property, strength, and durability, or a composite layer film in which an outer peripheral surface of a cylindrical film of polyimide or polyamide is coated with PTFE, PFA, or FEP (tetrafluoroethylene-hexafluoropropylene copolymer). A pressure roller 202 as a pressure member is a roller having a heat-resistant elastic layer 207, such as silicone rubber, concentrically and integrally provided in a roller shape on an outer periphery of a bar core 203.

The pressure roller 202 and the ceramic heater 205 on the stay 204 are pressed against each other via the film 201 against elasticity of the pressure roller 202. A range shown by an arrow N is a nip portion formed by the pressing. The pressure roller 202 is rotationally driven at a predetermined circumferential velocity in a direction of an arrow B by a fixing driving motor (not shown). The rotational driving of the pressure roller 202 directly applies torque to the film 201 by a frictional force between the roller 202 and an outer surface of the film 201 in the nip portion N.

When the recording material 210 is introduced into the nip portion N in a direction of an arrow A, torque is indirectly applied via the recording material 210 to the film 201 to drive the film 201 to be slid while being pressed against a lower surface of the ceramic heater 205 and rotated in a clockwise direction C. Thus, the heater 205 is provided to rub the inner peripheral surface of the film 201 to heat the film 201.

The stay 204 also functions as a guide member configured to guide an inner surface of the film 201. In order to reduce sliding resistance between the inner surface of the film 201 and the lower surface of the ceramic heater 205, a small amount of lubricant, such as heat-resisting grease, may be applied therebetween.

In a state where steady rotation of the film 201 by rotation of the pressure roller 202 is performed, and the temperature of the ceramic heater 205 increases to a predetermined temperature, the recording material 210 is introduced. Specifically, the recording material 210 on which an image is to be fixed is introduced between the film 201 and the pressure roller 202 in the nip portion N formed by the ceramic heater 205 and the pressure roller 202 via the film 201. Then, the recording material 210 is held and conveyed together with the film 201 in the nip portion N, and thus heat of the ceramic heater 205 is applied via the film 201 to an unfixed image on the recording material 210, and the unfixed image on the recording material 210 is fixed on the recording material 210.

The recording material 210 having passed through the nip portion N is separated from the surface of the film 201 and conveyed. The arrow A in FIG. 3 shows a conveying direction of the recording material 210. A thermistor 206 is pressed on the ceramic heater 205 with predetermined pressure to detect the temperature on the surface of the ceramic heater 205. Detecting the temperature on the surface of the ceramic heater 205 corresponds to indirectly detecting the temperature of the film 201 as a fixing member.

A thermistor 305 (FIG. 4) as a first temperature detecting member provided in a position on the central portion of the heater 205 and corresponding to the sheet-passing area of the recording material detects the temperature at a position corresponding to the sheet-passing area of the film 201. A detailed configuration of the thermistor will be described later.

In FIG. 3, a cooling system 221 applies cooling air to the non-sheet-passing area of the heating roller 202 created when small-size recording materials having a small width in a direction crossing the conveying direction of the recording material are continuously passed, to suppress an excessive temperature increase of the heating roller 202. An air supplying fan 222 supplies air in a direction of an arrow D. A duct 223 applies cooling air to the film 201 to cool the film. Cooling systems 221 are provided on opposite ends of the film 201. A detailed configuration of the cooling system 221 will be described later.

(Heater)

Figure 4:
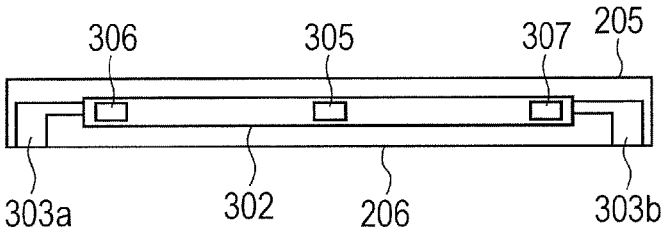
FIG. 4 is a configuration view of a ceramic heater in the first embodiment.

FIG. 4 is a configuration view of the heater 205. The heater 205 is provided long in a direction perpendicular to the conveying direction of the recording material. Alumina ($Al_2O_3$) is used as a base material, and a heat generating pattern 302 is formed by printing on one surface. The heat generating pattern 302 is coated with a glass protective film as an electric insulating layer. Power feeding electrodes 303*a* and 303*b* are formed to apply a voltage across the heat generating pattern 302.

(Temperature Detecting Member)

In the fixing device of this embodiment, as shown in FIG. 4, three thermistors are provided as temperature detecting members for measuring the temperature of the ceramic heater 205, and each thermistor is pressed on the ceramic heater with predetermined pressure. FIG. 4 illustrates placement positions of thermistors 305, 306 and 307. In a longitudinal direction of the heater, the thermistor 305 as a first temperature detecting member is placed on a central portion, and the thermistors 306 and 307 as a second temperature detecting member are placed on end portions. Each thermistor is input to the CPU 5 (FIG. 2) in the image forming apparatus via the temperature detecting circuit (not shown).

The thermistors 305, 306 and 307 may be configured to be brought into contact with the film 201 to detect a temperature of the film 201.

(Power Control Circuit)

Figures 5, 6:
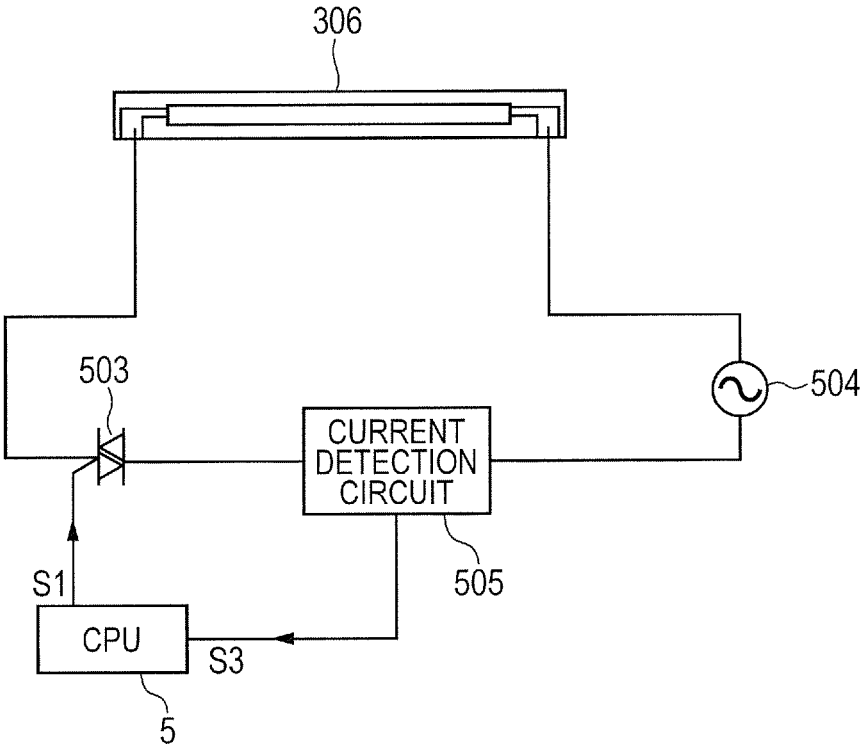
FIG. 5 illustrates a power control circuit in the first embodiment.
FIG. 6 illustrates a shutter position in the first embodiment.

Next, a control device configured to supply a power to the heater 205 will be described. FIG. 5 illustrates connection of a circuit of the control device. The CPU 5, a triac 503, and an AC power supply 504 are provided. The triac 503 and the heater 205 are connected in series, and a voltage is applied by the AC power supply 504. The triac 503 is ON/OFF controlled by a heater driving signal S1 from the CPU 5 to energize the heater 205. The heater driving signal S1 can be ON/OFF controlled based on a detection output of the thermistor described above to control the power that is supplied to the heater 205 so that the temperature of the heater 205 becomes a predetermined target temperature.

In this embodiment, the control device controls the power supplied to the heater 302 so that a detection value of the thermistor 305 placed on the central portion of the heater corresponding to the sheet-passing area reaches 200° C. as a target temperature. Specifically, an electric current detecting circuit 505 in FIG. 5 detects the amount of electric current flowing in the heater 302. The electric current detecting circuit 505 has a configuration disclosed in Japanese Patent Application Laid-Open No. 2009-251030 or the like,and is of a type sequentially detecting an electric current flowing in the fixing device.

A detection result of the electric current detecting circuit 505 is input to the CPU 5 by a signal S3 (FIG. 5), a detected electric current value is squared by the CPU 5 and further subjected to time averaging to obtain a final electric current value. Averaging is performed every one second and successively updated. The power of the heater 205 is proportional to a square of the value of the applied electric current, and thus the amount of power applied to the heater 205 can be detected by the signal S3 as a detection result of the electric current detecting circuit 505.

(Cooling System)

Figure 7:
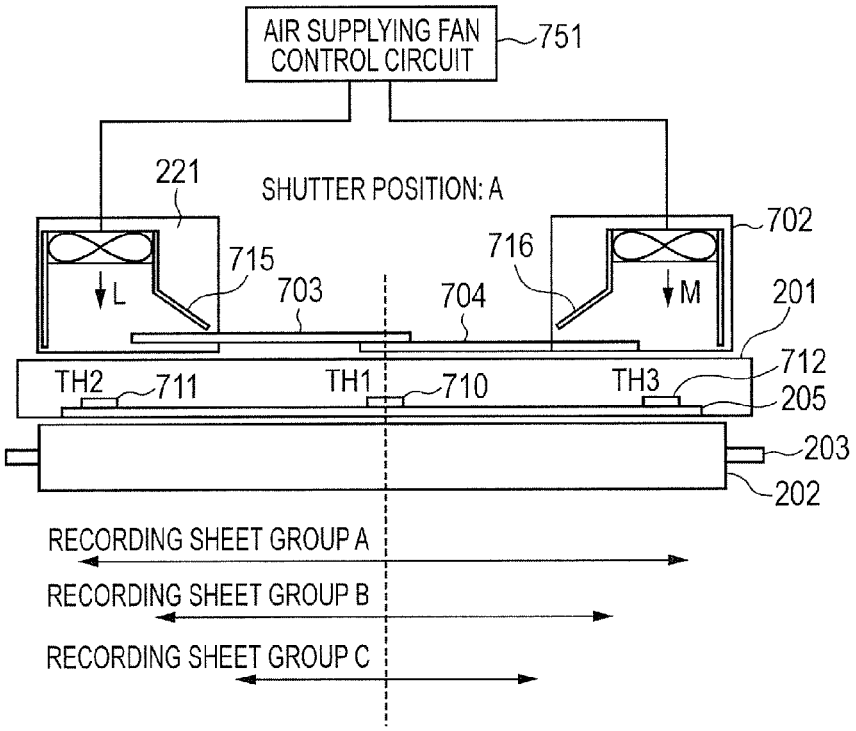
FIG. 7 illustrates an air supplying member when a recording material size is a group B in the first embodiment.

Next, with reference to FIG. 7, a configuration of a cooling system for fixing and cooling, which is provided in the fixing device, will be described in detail. The cooling system includes air supplying fans 221 and 702 on opposite end portions of the fixing device. The fans 221 and 702 are driven by a control circuit 751. Cooling air supplied by the air supplying fans 221 and 702 passes through ducts 715 and 716, respectively, and is applied to the film 201 in directions of arrows L and M, thereby cooling the film 201.

Figure 9:
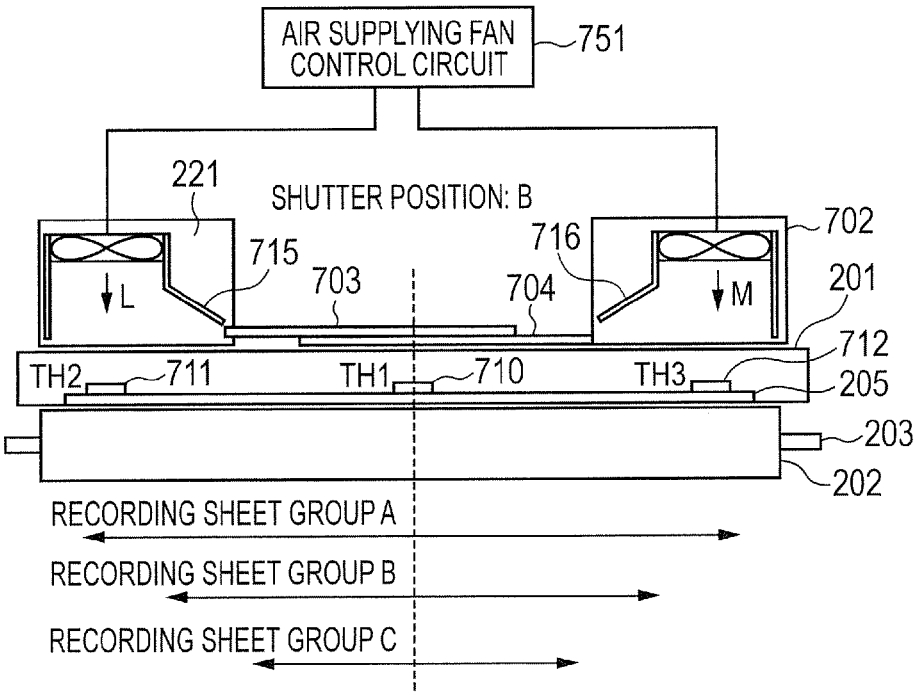
FIG. 9 illustrates a shutter position when a recording material size is group C in the first embodiment.

Shutters 703 and 704 are driven by a driving member (not shown) to adjust an air supplying area of the cooling air supplied from the air supplying fans 221 and 702. There are two shutter positions: a position A in FIG. 7 and a position B in FIG. 9, and a cooling air supplying area is switched between the positions. The shutter position is determined based on a shutter position setting table in FIG. 6. When the recording material belongs to a group B in FIG. 6, the shutters 703 and 704 are set in the position A (FIG. 7), and when the recording material belongs to a group C, the shutters 703 and 704 are set in the position B (FIG. 9).

Figure 10:
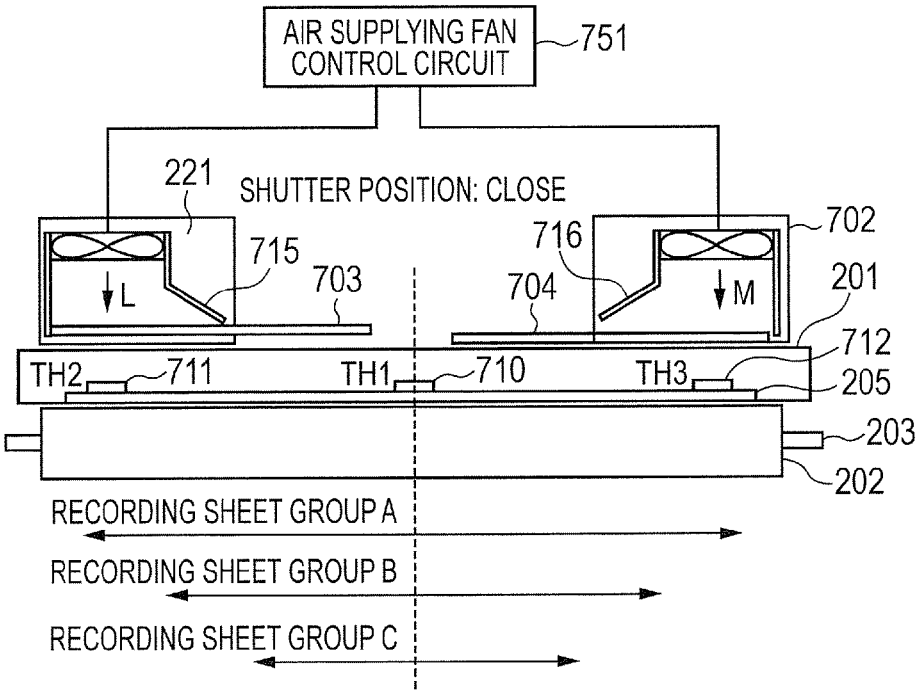
FIG. 10 illustrates a shutter position when a recording material size is group A in the first embodiment.

The length in a width direction of an air supplying port is thus adjusted according to the size of the recording material, and thus an air supplying area to the opposite end portions of the film 201 can be adjusted to accommodate recording materials of various sizes. When the recording material belonging to the group A is passed, the shutters 703 and 704 are closed as shown in FIG. 10. The recording material belonging to the group A has substantially the same width as a heating element of the heater 205, and thus a temperature increase at a non-sheet passing area hardly occurs. Thus, driving of the air supplying fan during printing is stopped.

(Control Circuit for Air Supply)

Figure 8:
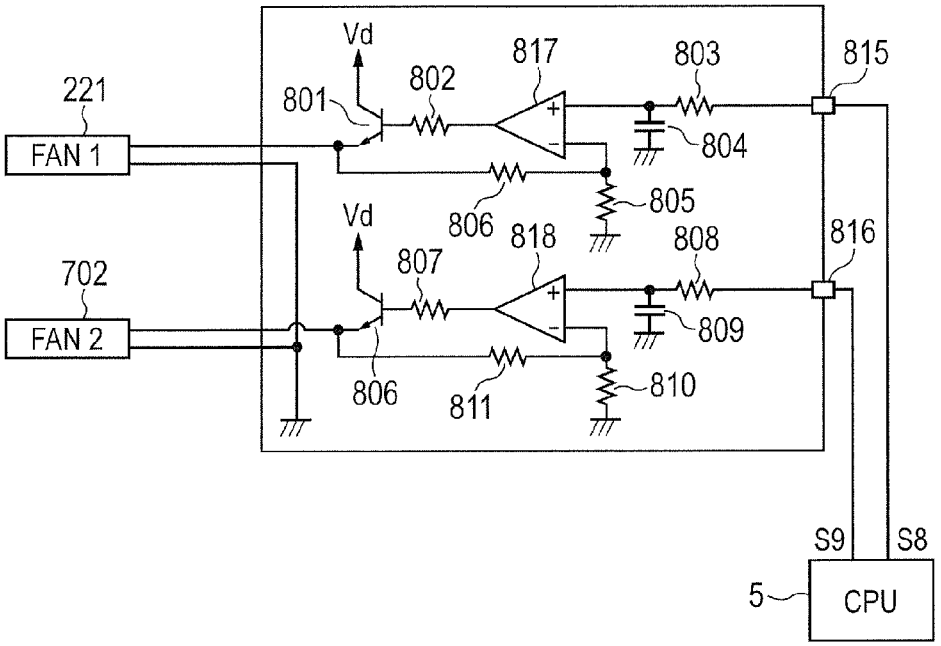
FIG. 8 illustrates a fan driving circuit in the air supplying member in the first embodiment.

FIG. 8 illustrates an inner configuration of the control circuit 751 (FIG. 7) for air supply. The control circuit 751 drives two air supplying fans 221 and 702, which are controlled by signals S8 and S9, respectively, output from the CPU 5. The signals S8 and S9 output from the CPU 5 are pulse-width modulated signals. The signal S8 input from a terminal 815 is converted into a DC voltage by a filter constituted by a resistor 803 and a capacitor 804, and input to a positive input terminal of an operation amplifier 817.

If a voltage is generated at an output terminal of the operation amplifier 817, an electric current is applied to a base of a transistor 801 via a resistor 802 to turn on the transistor 801, and a voltage is applied to the air supplying fan 221. On the other hand, an emitter of the transistor 801 is connected to a negative input terminal of the operation amplifier via resistors 805 and 806. With such a circuit, a voltage of a level according to the signal S8 is applied to the fan 221. A driving voltage V 221 for driving the air supplying fan 221 can be expressed by the expression below.

$$V221=(R805+R806)/R805\times Vc\times \mathrm{DUTY}\ (S8) \qquad \text{(Expression 1)}$$

A driving voltage V702 for driving the air supplying fan 702 can be expressed by the exp ression below as well.

$$V702=(R810+R811)/R810\times Vc\times \mathrm{DUTY}\ (S9) \qquad \text{(Expression 2)}$$

R805, R806, R810 and R811 are resistance values of the resistors 805, 806, 810 and 811, respectively, and Vd is an amplitude voltage of the signals S8 and S9.

(Method for Controlling Air Supplying Fan)

Figure 11:
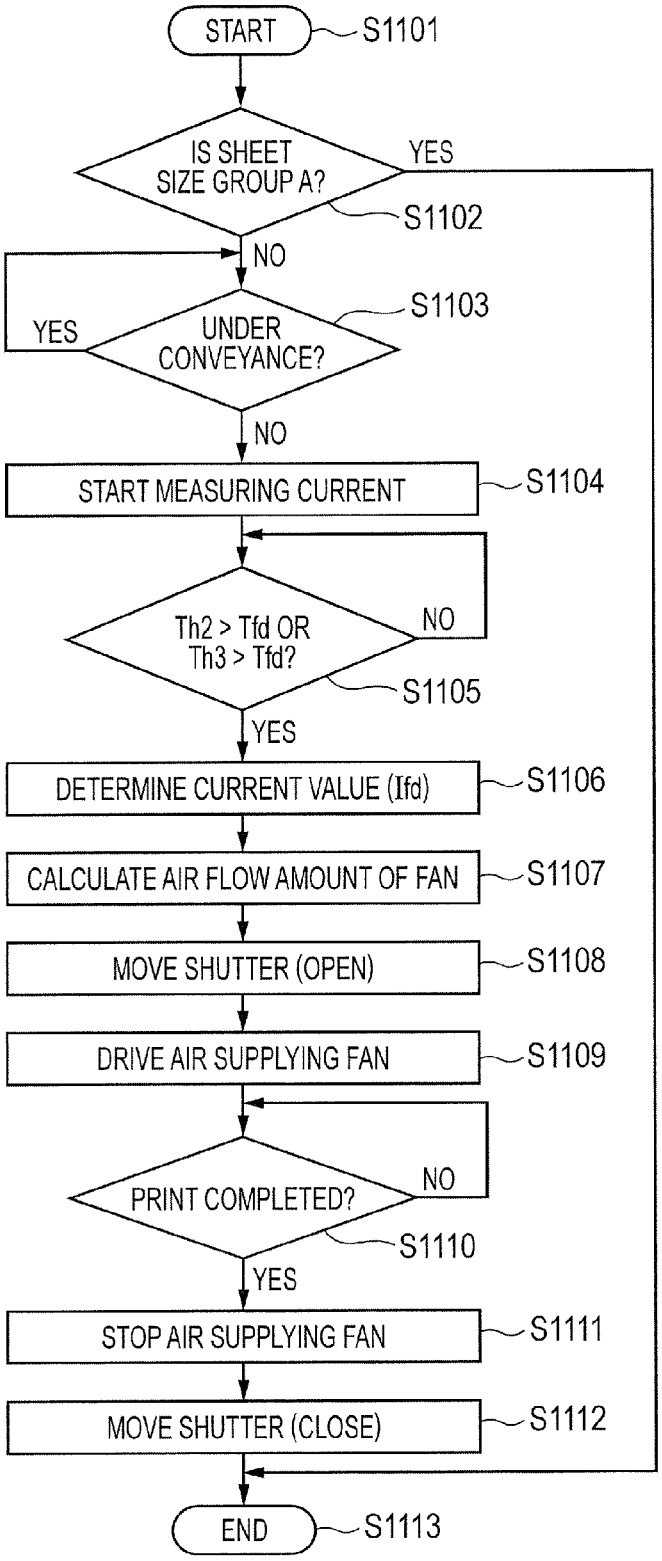
FIG. 11 is an air supplying control flowchart of the air supplying member in the first embodiment.
Figures 12, 13:
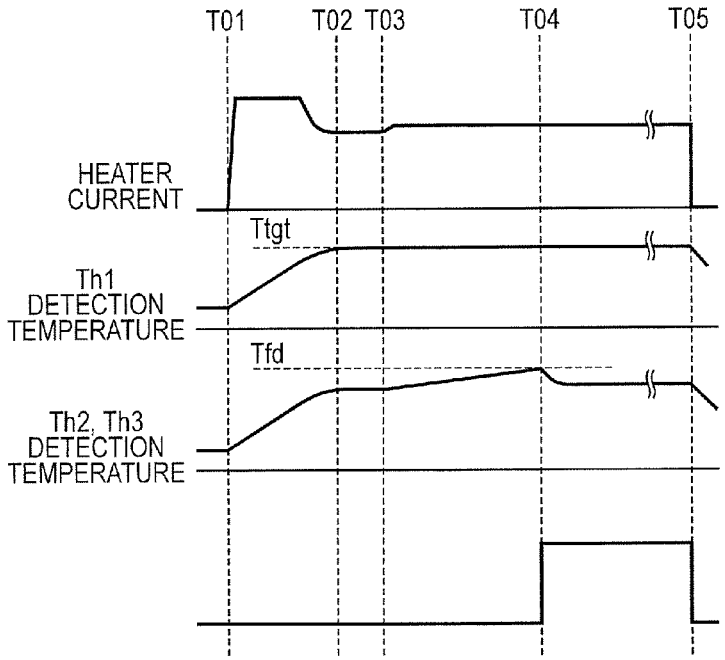
FIG. 12 is a timing chart in the first embodiment.
FIG. 13 is a fan driving voltage setting table in the first embodiment.

A method for controlling an air supplying fan in this embodiment will be described. In this embodiment, the quantity of air produced by the air supplying member is controlled based on the amount of supplied power (electric current value) when the temperature detected by the end portion thermistor as the second temperature detecting member provided in a position corresponding to the non-sheet-passing area of the heater 205 reaches a predetermined temperature. FIG. 12 illustrates a value of the electric current flowing in the heater during continuous printing, the temperature of the end portion thermistor, and the driving timing of the air supplying fan. FIG. 11 is a flowchart illustrating a series of steps of the control method of the air supplying fan. In FIG. 12, when printing is started at timing T01, and a warm-up of the fixing device 116 is started, the control device described above supplies an electric current to the heater 205.

When the warm-up of the fixing device is started, detection temperatures of a thermistor Th1 (first temperature detecting member) placed on the central portion of the heater 205 and thermistors Th2 and Th3 (second temperature detecting member) placed on the end portions increase. In this embodiment, the thermistors Th2 and Th3 are provided in the non-sheet-passing area through which a minimum size recording material that can be passed is not passed.

The electric current flowing in the heater 205 is controlled by the control device so that the temperature of the thermistor Th1 placed on the central portion of the heater 205 becomes a target temperature Ttgt (first target temperature). When the temperature of the thermistor Th1 continuously increases and the temperature of the thermistor Th1 reaches the target temperature Ttgt, the recording material is fed from the deck 101 (timing T02).

After the electrophotographic process described above, the recording material reaches the fixing device 116 (timing T03), and is subjected to fixing. After the recording material is passed in the fixing device 116, the thermistor Th1 is maintained at the target temperature Ttgt.

The temperatures of the thermistors Th2 and Th3 placed on the end portions of the heater 205 continuously increase beyond the target temperature Ttgt by the temperature increase at the non-sheet passing area. When either the thermistor Th2 or Th3 reaches the predetermined temperature Tfd, driving of the air supplying fan is started (timing T04). After driving of the air supplying fan, the temperatures of the thermistors Th2 and Th3 decrease. When an image forming operation of the recording material is finished (timing T05), the supply of the electric current to the heater 205 is stopped to stop the air supplying fan. Next, with reference to FIG. 11, a control procedure of the air supplying fan will be described.

At the timing T01 (FIG. 12), recording materials to be printed, which printing method starts in step S1101, are classified into the groups A, B and C, according to the table shown in FIG. 6, and it is determined whether the recording material belongs to the group A in step S 1102. When the recording material belongs to the group A, the process moves to S1113, and printing is performed without driving the air supplying fan. In the case of the group A, the air supplying fan is not driven for the reason described above. On the other hand, in the case of the group B or C, the operation of the air supplying fan is performed in a series of processes starting in step S1103 and continuing until step S1113.

When a detection temperature of the thermistor Th1 reaches the target temperature Ttgt at the timing T02 (FIG. 12), in S1103, a state of passage of the recording material in the fixing device 116 is checked, and if the recording material is not under conveyance, the process moves to S1104 at the time of passage of the recording material, and measurement of the electric current flowed in the heater 205 is started by the electric current detecting circuit described above. Further, in S1105, the detection temperatures of the end portion thermistors Th2 and Th3 are monitored, and when any of the detection temperatures reaches a predetermined temperature Tfd, processes in S1106 to S1109 are performed. Specifically, the value of the electric current flowing in the heater 205 is settled, a quantity of air of the air supplying fan is calculated and determined based on the settled electric current value, a shutter is moved, and the air supplying fan is driven by the determined quantity of air.

As such, the power which is supplied to the heater 205 is controlled so that the detection temperature of the thermistor Th1 becomes a target temperature. An electric current value Ifd when the detection temperatures of the thermistors Th2 and Th3 reach the predetermined temperature Tfd is settled. As described above, for the value of the electric current flowing in the heater, a moving average value is measured for every one second, and thus the electric current value Ifd is an average value of a section one second before the timing T04. The electric current value Ifd may be an electric current value at the timing T04.

Then, in S1107, the quantity of air of the fan is determined based on the electric current value Ifd. The quantity of air of the air supplying fan is determined according to the electric current value Ifd, and the size of the recording material which is passed. Specifically, the quantity of air is determined using a setting table of a driving voltage of the air supplying fan in FIG. 13. The recording materials are classified into groups I to IV determined according to the recording material size in a main scanning direction. The electric current value Ifd is classified into four types, and the driving voltage of the air supplying fan is determined by a combination of the electric current value Ifd and the recording material size. For example, when the recording material is LTR horizontal, and the electric current value Ifd is 8 A, the recording material size is the group II, and the heater electric current value is classified into a group of 7 A≤Ifd<9 A. Thus, the fan driving voltage is determined to 10 V.

As shown in FIG. 13, the driving voltage of the air supplying fan is set to a higher value for a larger heater electric current value Ifd. Specifically, the control device performs control to increase the quantity of air of the air supplying fan with increasing electric current flowing in the heater. This is because the temperature increasing speed at the non-sheet-passing area more easily increases for a larger electric current value Ifd, and the cooling capacity generated by the air supplying fans 221 and 702 needs to be increased to suppress the temperature increase on the non-sheet-passing area without overshooting.

The fan driving voltage, which is -different according to the recording material size, is set because the amount of electric current needed to be supplied to the heater 205 differs depending on the widths of the recording material in the direction perpendicular to the conveying direction of the recording material. The driving voltage of the air supplying fan can be set in this manner to set a proper quantity of air of the air supplying fan for suppressing the temperature increase at the non-sheet-passing area. The recording material size is also information related to the power which is supplied to the heater.

As such, as described above in S1108 in FIG. 11, driving of the air supplying fan is started in S1109 with a driving voltage of the air supplying fan determined in S1107 after the shutter is moved to a predetermined position shown in to FIG. 10 (timing T04 shown in FIG. 12). When it is determined in S1110 that printing is finished, the air supplying fan is stopped in S1111, the shutter is closed in the S1112, and the series of processes is finished.

According to this embodiment, the quantity of air of the air supplying fan is adjusted according to the power which is supplied to the ceramic heater and the size of the recording material. Thus, a proper quantity of air of the air supplying fan is obtained even when any type and/or size of the recording material passes, thereby avoiding poor fixing or hot offset.

As described above, in the image heating apparatus of this embodiment, at the timing when the detection temperatures of the end portion thermistors Th2 and Th3 reach the predetermined temperature, the electric current value is settled, the quantity of air of the fan is calculated, the shutter is moved, and the air supplying fan is driven. With such control, a proper quantity of air of the air supplying fans 221 and 702 can be obtained even when any type of the recording material passes, thereby avoiding poor fixing or hot offset.

<Second Embodiment>

A basic configuration of the image heating apparatus in this embodiment is the same as that of the image heating apparatus in the first embodiment, and only a method for controlling the air supplying fan is different.

First, a configuration common to the first embodiment will be described. In this embodiment, as in the first embodiment, an electric current flowing in a heater 205 is controlled by a control device so that a detection temperature of a thermistor Th1 placed on a central portion of the ceramic heater 205 becomes a target temperature Ttgt. Temperatures of thermistor Th2 and Th3 placed on end portions of the heater 205 continuously increase beyond the target temperature Ttgt by the temperature increase at non-sheet-passing area. When either the thermistor Th2 or Th3 reaches a predetermined temperature Tfd, driving of the air supplying fan is started.

This saves energy as compared to a case where driving of the air supplying fan is started from before the predetermined temperature Tfd is reached. The detection temperatures of the thermistors Th2 and Th3 are not only used to determine driving start timing of the air supplying fan, but also are used for determining the detection timing of the electric current flowed in the heater 205.

A difference between this embodiment and the first embodiment will be described. In this embodiment, unlike the first embodiment, even after a driving voltage of the air supplying fan is determined to start driving of the air supplying fan in the same manner as in the first embodiment, the driving voltage of the air supplying fan is adjusted according to a detection result of an end portion thermistor Th2, denoted in FIGS. 7, 9, and 10 by reference numeral 711.

Figure 15:
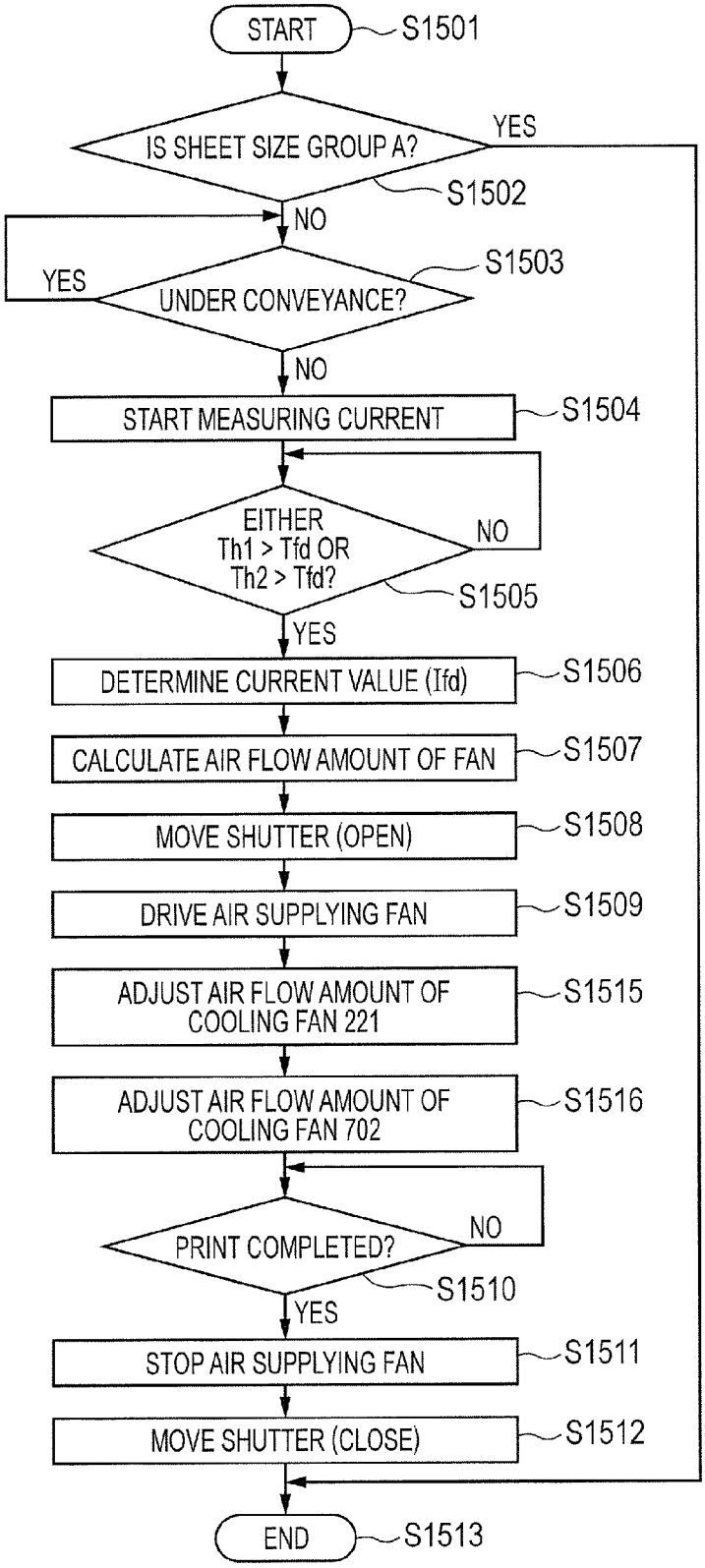
FIG. 15 is an air supplying control flowchart of an air supplying member in the second embodiment.
Figure 16A:
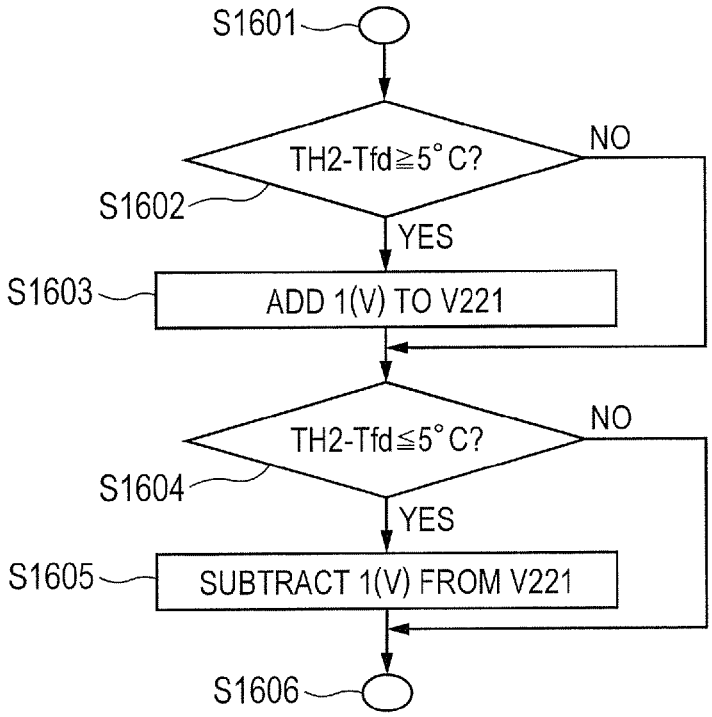
FIGS. 16A and 16B are air supplying control flowcharts for adjusting a driving voltage of an air supplying fan in the second embodiment.
Figure 16B:
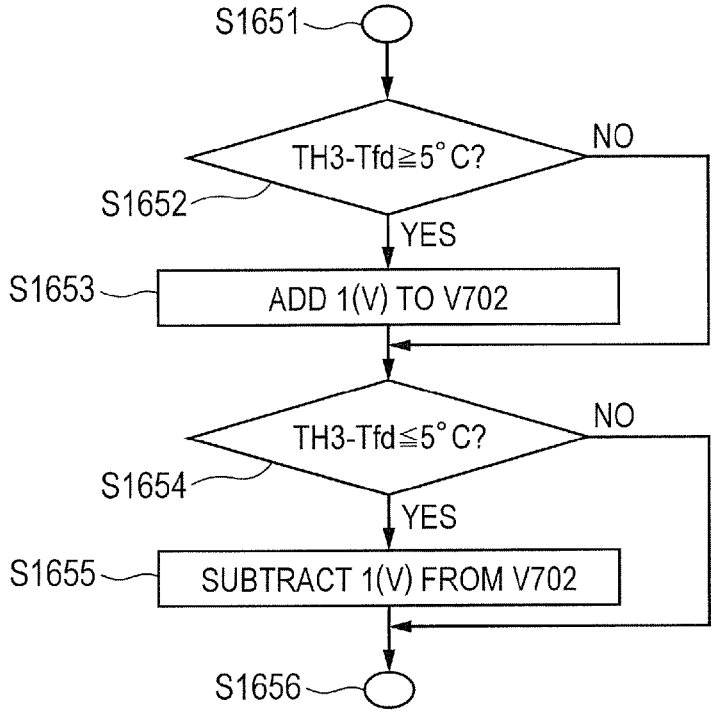

FIG. 15 illustrates a flow of a series of steps for control of an air supplying member during printing. Unlike the control sequence in the first embodiment, in S1515 and S1516 in FIG. 15, the quantities of air of two air supplying fans 221 and 702 are adjusted. In FIGS. 16A and 16B, a control flow in S1515 is shown by S1601 to S1606, and a control flow in S1516 is shown in S1651 to S1656.

Figure 14:
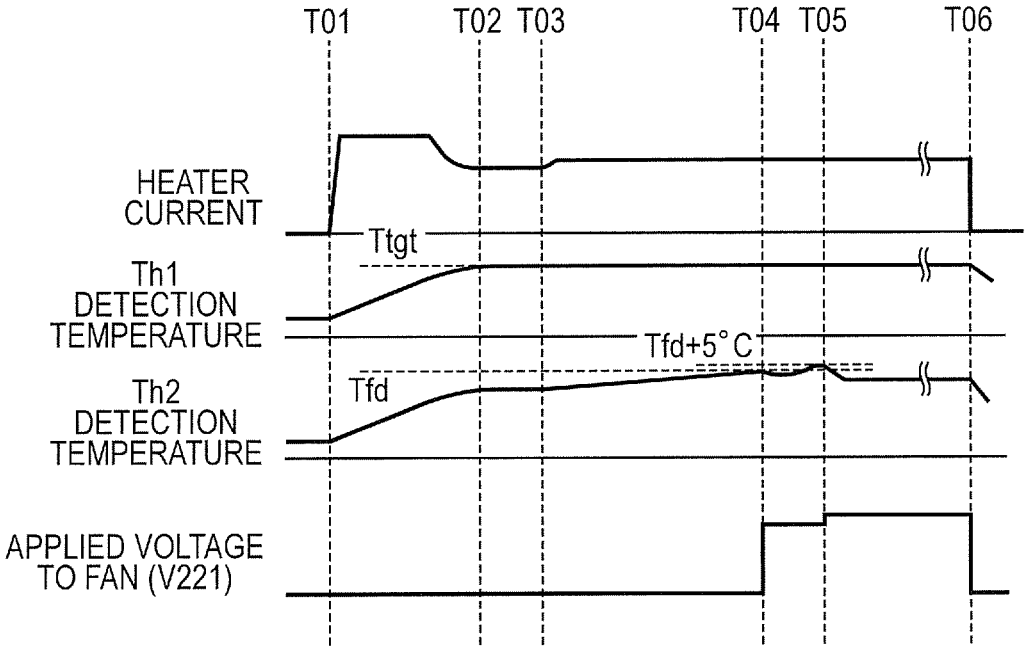
FIG. 14 is a timing chart in a second embodiment.

In S1602, a detection temperature of the thermistor Th2, 711 as a second temperature detecting member placed on the end portion of the heater 205 is compared with the predetermined temperature Tfd. When the temperature of the thermistor Th2, 711 is higher than Tfd by 5°C. or more (FIG. 16A), a driving voltage V221 of the air supplying fan 221 is increased by 1 V in S1603. When the temperature of the thermistor Th2, 711 Th2711 is lower than Tfd by 5°C. or more in S1604, the driving voltage V221 of the air supplying fan 221 is decreased by 1 V in S1605. FIG. 14 illustrates the heater electric current, the thermistor temperature, and the driving timing of the air supplying fan when the quantity of air of the air supplying fan 221 is adjusted in S1515.

At timing T04, the fan driving voltage V221 is output by the process in S1509. The air supplying fan 221 cools the end portion of the heater 205 to reduce the temperature of the thermistor Th2. The temperature of the thermistor Th2 then increases. This occurs when an optimum quantity of air of the air supplying fan 221 cannot be obtained, and an insufficient cooling capacity is provided. The cooling capacity that is not optimum may be due to an irregular situation such as the recording material being conveyed in a displaced state with respect to the center in the conveying direction or conveyed in a leaned state.

The temperature of the thermistor Th2 continuously increases, and at timing T05 when the temperature is higher than the predetermined temperature Tfd by 5° C., processes in S1602 and S1603 are performed, the fan driving voltage V221 increases by 1 V, and thus the temperature of the thermistor Th2 again decreases and is stabilized. With such control, even if the quantity of air of the air supplying fan 221 has not been set to an optimum value by the processes in S1501 to S1509, the quantity of air is again adjusted by the process in S1515 and can be set to an optimum level in a short time. The air supplying fan 702 is similarly controlled in processes in S1651 to S1656 as illustrated in FIG. 16B.

As described above, in this embodiment, when the temperatures of the end portion thermistors Th2 and Th3 become the target temperature, the electric current value is settled, the quantity of air of the fan is calculated, the shutter is moved, and the air supplying fan is driven. Further, after driving of the fan by the quantity of air determined by the method described above, the quantity of air of the air supplying fan is adjusted according to the detection result of the end portion thermistor, and thus a proper cooling capacity of the air supplying fans 221 and 702 can be set even during conveyance in a leaned state. This can avoid poor fixing or hot offset.

In the above description, the air supply by the air supplying fan 221 is started at the timing T04 when the temperatures of the end portion thermistors Th2 and Th3 reach the predetermined temperature. Alternatively, the same advantage can be obtained by measuring the electric current flowed in the heater at the timing T03 when the sheet is passed in the fixing device 116 to start air supply by the air supplying fan 221.

Besides, the above-described technical features may be combined or varied as appropriate within the scope of the present invention. Variants are, for example, as described below.

(Variant 1)

In the first and second embodiments described above, the electric current flowing in the heater is used to determine the quantity of air of the air supplying fan when driving of the air supplying fan is started, but a voltage applied to the heater may be used. The power which is supplied to the heater may be calculated from the value of the electric current flowing in the heater or the value of the voltage applied to the heater, and used to determine the quantity of air of the air supplying fan when driving of the air supplying fan is started. Information other than the above related to the power which is supplied to the heater may be used.

(Variant 2)

In the embodiments described above, the thermistor Th1 placed on the central portion of the heater 205, and also the thermistors Th2 and Th3 placed on the end portions of the ceramic heater 205 in positions accommodating recording materials having various widths are used, but the present invention is not limited to this. Specifically, as end portion thermistors, a plurality of thermistors may be provided on different positions for recording materials having different widths (position of non-sheet-passing areas of the recording materials), and the thermistors on different positions may be used depending on widths of the recording materials.

(Variant 3)

In the embodiments described above, in relation to the temperature on the sheet-passing area of the fixing member, the thermistor Th1 placed on the central portion of the heater 205 is used as a temperature detecting member configured to detect the temperature of a position corresponding to the sheet-passing area of the fixing member. The thermistor Th1 detects the temperature of the heater 205, but may directly detect a temperature of a film as a fixing member.

(Variant 4)

In the embodiments described above, air is supplied to the non-sheet-passing area of the fixing member, but air may be supplied to the non-sheet-passing area of at least one of the fixing member and the pressure member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-263566, filed Dec. 1, 2011, which is hereby incorporated by reference herein in its entirety.

What is claimed is:

1. An image heating apparatus for heating a toner image borne on a recording material while conveying the recording material at a nip portion, the image heating apparatus comprising:

a heater;

a fixing member heated by the heater;

a pressure member configured to form the nip portion with the fixing member;

a first temperature detecting member configured to detect a sheet-passing area temperature of the fixing member or the heater;

a second temperature detecting member configured to detect a non-sheet-passing area temperature of the fixing member or the heater;

a control device configured to control the heater power supplied to the heater for maintaining the temperature detected by the first temperature detecting member at a target temperature; and an air supplying member supplying cooling air to the non-sheet-passing area for cooling the fixing member, the air supplying member being started to be driven when the temperature detected by the second temperature detecting member reaches a predetermined temperature, wherein while the recording material is being conveyed at the nip portion, the control device controls the cooling air quantity of the air supplying member in response to an electric current flowing in the heater for adjusting the cooling level of the air supplying member, a rate at which the temperature of the non-sheet-passing area detected by the second temperature detecting member increases reflecting the electric current flowing in the heater.

2. An image heating apparatus according to claim 1, wherein the electric current flowing in the heater for controlling the quantity of the cooling air is acquired when the temperature detected by the second temperature detecting member reaches the predetermined temperature.

3. An image heating apparatus according to claim 1, wherein the larger the electric current, the larger the quantity of the air supplied by the air supplying member.

4. An image heating apparatus according to claim 1, wherein the fixing member is a tubular film.

5. An image heating apparatus according to claim 4, wherein the heater contacts an inner surface of the film and forms the nip portion together with the pressure member through the film.

* * * * *